US006907991B2

(12) United States Patent
Charrin et al.

(10) Patent No.: US 6,907,991 B2
(45) Date of Patent: Jun. 21, 2005

(54) PORTABLE PACKAGE FOR A FLORAL BOUQUET

(76) Inventors: André Charrin, Quartier des Chirouzes, Beaumont Monteux, 26600 Tain l'Hermitage (FR); Philippe Charrin, Quartier des Chirouzes, Beaumont Monteux, 26600 Tain l'Hermitage (FR)

( * ) Notice: Subject to any disclaimer, the term of this patent is extended or adjusted under 35 U.S.C. 154(b) by 0 days.

(21) Appl. No.: 10/363,179

(22) PCT Filed: Sep. 7, 2001

(86) PCT No.: PCT/FR01/02783

§ 371 (c)(1),
(2), (4) Date: Jul. 17, 2003

(87) PCT Pub. No.: WO02/20372

PCT Pub. Date: Mar. 14, 2002

(65) Prior Publication Data

US 2004/0011687 A1 Jan. 22, 2004

(30) Foreign Application Priority Data

Sep. 7, 2000 (FR) ..... 00 11414

(51) Int. Cl.[7] ..... B65D 85/52
(52) U.S. Cl. ..... 206/423; 47/72; 47/84
(58) Field of Search ..... 47/72, 84; 206/423; 383/15

(56) References Cited

U.S. PATENT DOCUMENTS 2,774,187 A * 12/1956 Smithers ..... 47/41.12
3,477,634 A * 11/1969 Kamins et al. ..... 383/15
3,528,471 A * 9/1970 Hartmann ..... 383/15
4,248,347 A * 2/1981 Trimbee ..... 206/423
4,400,910 A * 8/1983 Koudstaal et al. ..... 47/84
5,411,137 A * 5/1995 Weder et al. ..... 206/423
5,850,911 A * 12/1998 Pakzad ..... 206/217
6,446,805 B1 * 9/2002 Mann et al. ..... 206/423
6,665,982 B1 * 12/2003 Van Wingerden ..... 47/72

FOREIGN PATENT DOCUMENTS

| | | |
|---|---|---|
| DE | 1927025 | 1/1971 |
| FR | 1509896 | 2/1969 |
| FR | 2072893 | 9/1971 |
| FR | 2144460 | 2/1973 |
| FR | 2176640 | 11/1973 |
| FR | 2784659 | 4/2000 |
| WO | 9637133 | 11/1996 |
| WO | 9858854 | 12/1998 |

* cited by examiner

*Primary Examiner*—John A. Ricci
(74) *Attorney, Agent, or Firm*—Polster, Lieder, Woodruff & Lucchesi, L.C.

(57) ABSTRACT

The invention concerns a portable packaging device for a floral bouquet, comprising a support element (14) for maintaining the bouquet (12), and a packaging film (16) made of soft material designed to enclose the support element (14). The packaging film (16) is provided with carrier means (18) designed to be fixed when the sheet (16) is laid flat in unfolded state, and to be positioned in a state to be grasped when the sheet (16) encloses the lateral surface of the support element (14). The carrier means (18) are formed by a couple of handles **(18*a*, 18*b*) fixed to the packaging film (16) with securing members (20*a*, 20*b*)**.

9 Claims, 7 Drawing Sheets

F3

PORTABLE PACKAGE FOR A FLORAL BOUQUET

TECHNICAL AREA OF THE INVENTION

The invention concerns a portable packaging device for a flower bouquet, comprising a support element for maintaining the bouquet, and a packaging sheet of a flexible material intended to enclose the support element.

Traditionally, transport of flower bouquets is done by holding the stems from below, or by placing the bouquet or flowerpot into a basket. In both cases, the bouquet could be subjected to undesirable shocks or pressures, which risk damaging both the packaging and the flowers.

BACKGROUND OF THE INVENTION

U.S. Pat. No. 5,740,658 discloses a decorative packaging cover designed to enclose a pot of flowers. Handles are attached to the upper part of the cover by a perforated detachable connection, which then allows the handles to be removed. Incorporation of the handles is done by cutting the covering film.

French Pat. No. 2,784,659 describes a packaging device for transporting foodstuffs or other contents. It consists of a base and four branches arranged in a cross. The ends of two opposing branches feature openings for grasping and carrying the device.

OBJECT OF THE INVENTION

The object of the invention is to produce a simple packaging device that will facilitate the transport of a bouquet or pot of flowers.

The packaging device, according to the invention, is characterized by the fact that a packaging sheet is equipped with a transport means arranged so as to be put into place when the sheet is laid flat in the unfolded state, and to be positioned in the gripping state when the sheet surrounds the lateral surface of the support element. The transport means comprises a pair of handles fastened to the packaging sheet by attachment elements.

Integration of the handles into the packaging sheet for transporting the bouquet eliminates the use of a special bag adapted to the shape of the bouquet. Fastening the attachment elements can take place using any assembly process, notably welding, gluing, or stapling onto the packaging sheet.

According to one characteristic of the invention, the attachment elements include back-up fasteners designed to work together to maintain the sheet in the position where the handles can be gripped. The fasteners can be male and female clipping buttons or hook-and-loop fastening strips. Thus the setting up of the packaging device is quick, and eliminates the use of a cord.

According to another characteristic of the invention, the transport means work together with an extendable re-tightening connection that is part of the packaging sheet, which is folded and closes automatically on the support element when the user pulls on the carrying device. A single separating gesture is enough to set up the packaging sheet and the carrying handles.

According to another characteristic of the invention, the packaging sheet is lengthened by a pliable transparent piece, designed to pass between the handles to cover the bottom of the bouquet. Thus the flowers in the bouquet are properly protected, which eliminates the need for stapling the upper part of the packaging sheet.

The invention also concerns a packaging sheet for a bouquet or flowerpot, comprising an impermeable flexible film, cut out according to a predetermined shape, and a carrying means arranged so as to be put into place when the sheet lies flat in an unfolded state, and to be positioned in the gripping state when the sheet surrounds the flower bouquet or the potted plants. The carrying means comprises a pair of handles attached to the packaging sheet by fixing devices.

The film is conveniently made of a plastic material, specifically from polypropylene.

SUMMARY DESCRIPTION OF DRAWINGS

Other advantages and characteristics will become clear from the description which follows, of a means of production of the invention. This means of production is given as a non-limiting example, and is shown in the attached drawings, in which.

DESCRIPTION OF A PREFERRED METHOD OF PRODUCTION

Figure 1:
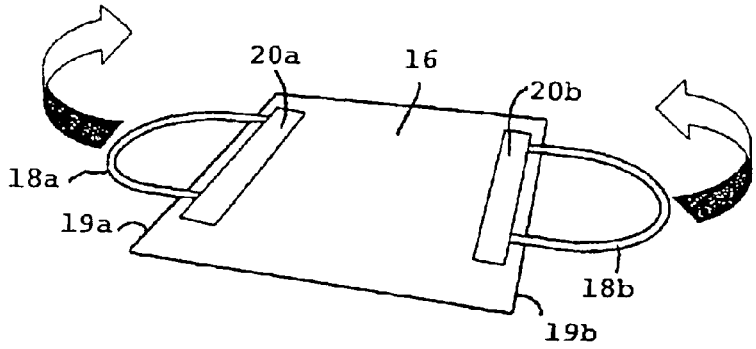
FIGS. 1 to 3 are schematic views of the packaging device with a rectangular sheet, shown, respectively, flat, and as it is being folded around the bouquet support.
Figure 2:
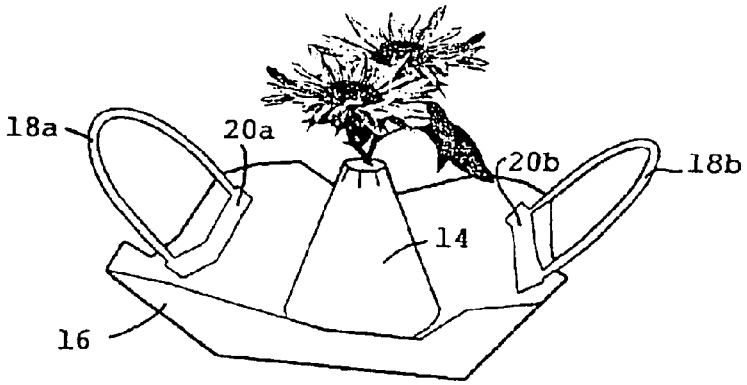
Figure 3:
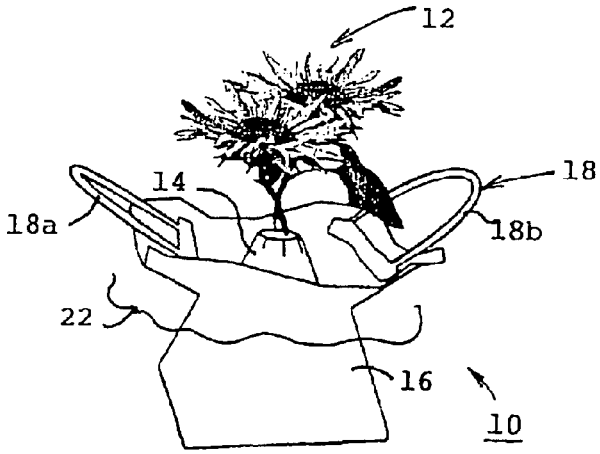
Figure 3A:
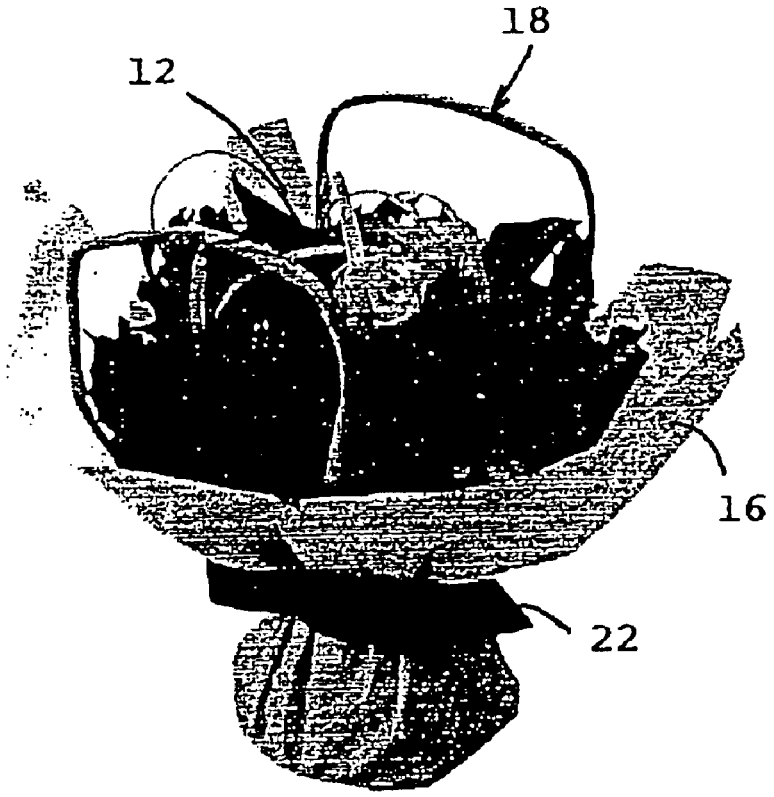
FIG. 3A shows a perspective view of the bouquet, packaged with its transport system.

In FIGS. 1 to 3A, a portable packaging device (10) for a flower bouquet (12) comprises a support element (14) for holding the bouquet in a vertical position and a packaging sheet (16) for transport means (18).

The support element (14) can be of the type described in document WO 96/37133, now U.S. Pat. No. 6,018,908, and is put into shape starting with a semi-circular piece cut out when flat. The piece is of a very thin flexible material, notably plastic or cardboard, having a predetermined stiffness after being rolled into the shape of a truncated cone. It is clear that the support element (14) can be made by any other system of support, for example by a preformed support in the shape of a pot or vase.

The packing sheet (16) is a film made of impermeable flexible material, for example polypropylene, and is cut out in a rectangular or square shape. The transport means (18) comprises a pair of handles **(18*a*, 18*b*) attached along the two sides (19*a*, 19*b*) or opposing corners of sheet (16) by attachment elements (20*a*, 20*b*)**.

Placement of attachment elements **(20*a*, 20*b*) of handles (18*a*, 18*b*) takes place when sheet (16) is flat in the unfolded state (FIG. 1). Attachment can be carried out by any appropriate assembly process, notably by welding, gluing, stapling, adhesive bands, etc. The two handles (18***a*, 18*b*) project from the two sides (19*a*, 19*b*) of sheet (16) and form an upside-down U.

The support element base (14) need only be placed on the flat sheet (16), then handles (18*a*, 18*b*) lifted up (FIG. 2), so as to enclose the entire lateral surface of support element (14) with sheet (16).

A cord (22) (FIGS. 3 and 3A) is then knotted around sheet (16) at the level of the upper portion of the support element (14) to complete the packaging device (10). The bottom is thus perfectly watertight, and the two handles (18*a*, 18*b*) project towards the top, making the transport system for bouquet (12).

Figure 4:
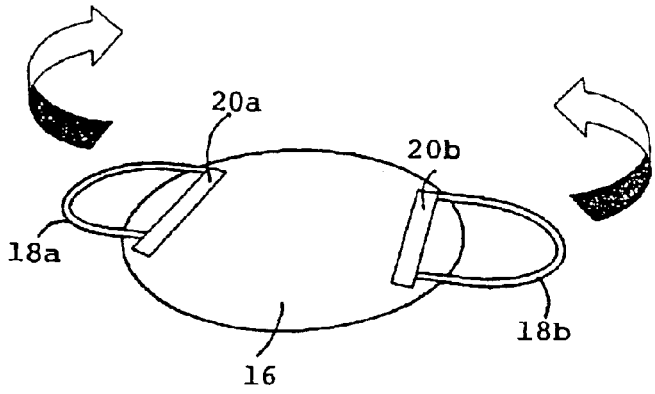
FIGS. 4 to 6 show views identical to FIGS. 1 to 3 of a variation of the means of production, using a round or oval sheet.
Figure 5:
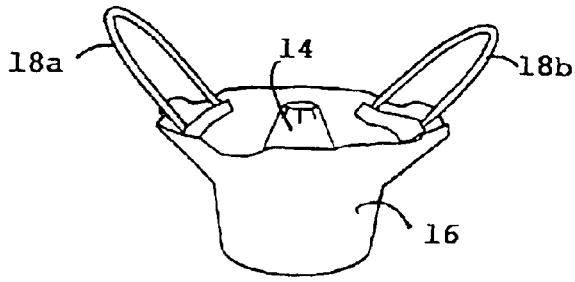
Figure 6:
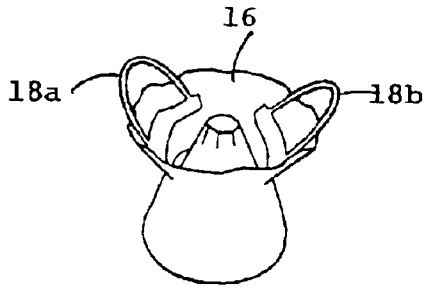

Referring to FIGS. 4 to 6, the packaging sheet (16), instead of being quadrangular, is cut into a circular profile. Handles (18*a*, 18*b*) are placed diametrically opposite each other, and are connected by attachment elements (20*a*, 20*b*) to unfolded sheet (16) (FIG. 4). Lifting handles (18*a*, 18*b*) according to FIGS. 5 and 6 is identical to that described previously, and allows support (14) to be enclosed with sheet (16). The surface of sheet (16) can also be oval.

Figure 7:
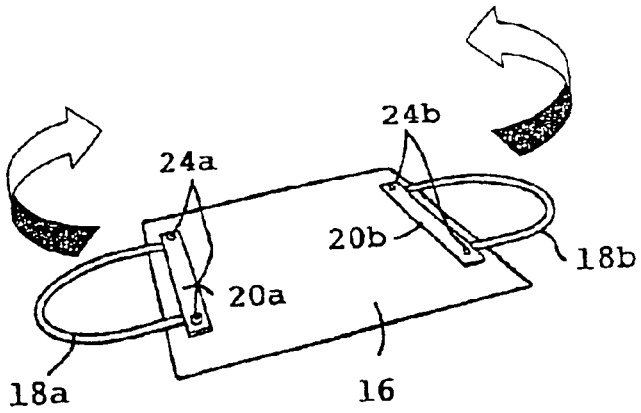
FIGS. 7 and 8 illustrate a packaging sheet that is equipped with handles and a clipping system, where the sheet is, respectively, flat and in the folded and clipped position.
Figure 8:
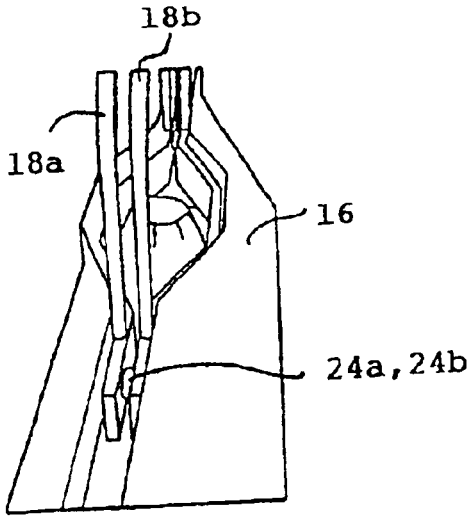

In FIGS. 7 and 8, the attachment elements (20*a*, 20*b*) of handles (18*a*, 18*b*) are equipped with back-up fastening elements (24*a*, 24*b*) designed to connect together when sheet (16) is folded upwards. The fastening elements (24*a*, 24*b*) can be male and female clipping buttons, or hook-and-loop fastening strips known under the brand name VELCRO®. The setup of packaging device (10) is quick, and eliminates the use of a cord.

Figure 9:
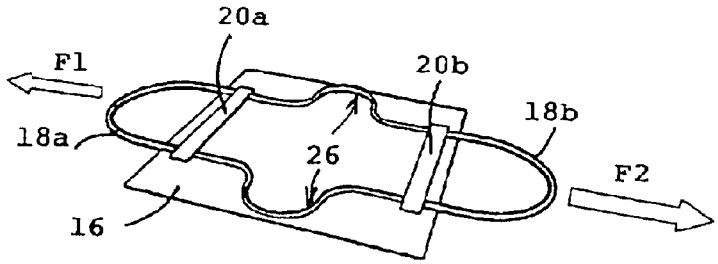
FIGS. 9 to 11 show a packaging sheet equipped with handles and a quick-setup system, where the sheet is shown, respectively, flat and as it is being folded when the handles are pulled, and in the final position folding around the support.
Figure 10:
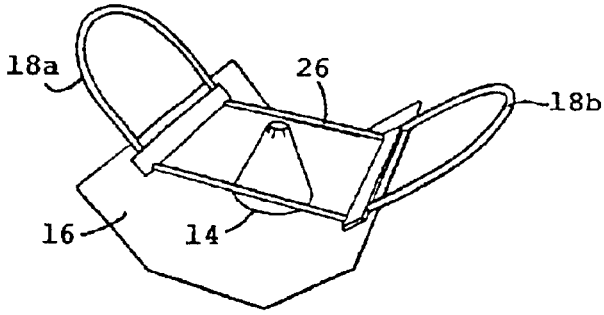
Figure 11:
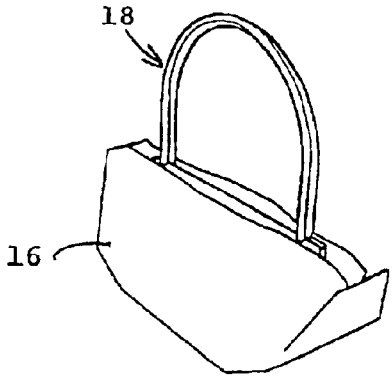

In FIGS. 9 to 11, handles (18*a*, 18*b*) are interconnected by an extensible tightening link (26) intended to slide through attaching elements (20*a*, 20*b*) when the user pulls on handles (18*a*, 18*b*) in opposite directions (arrows F1 and F2). The extendable link (26) is an integral part of sheet (16) and is unfolded completely when sheet (16) is flat (FIG. 9). When sheet (16) is folded, it closes automatically onto support element (14) when the user pulls on handles (18*a*, 18*b*) (FIG. 10). When link (26) has been fully tightened, sheet (16) is folded down around support element (14), and the two handles (18*a*, 18*b*) are juxtaposed.

Figure 12:
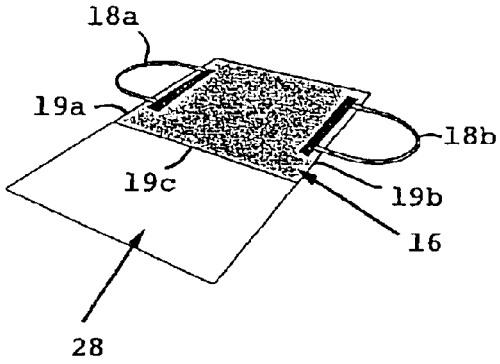
FIGS. 12 to 14 are views identical to those in FIGS. 1 to 3 of another variation of the means of production.
Figure 13:
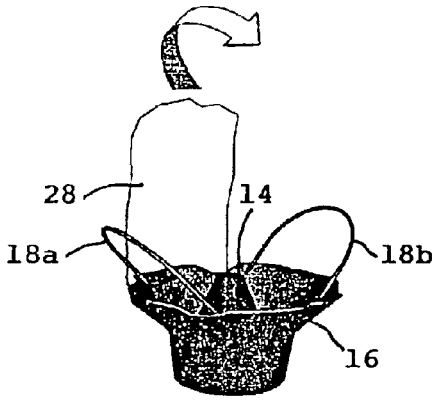
Figure 14:
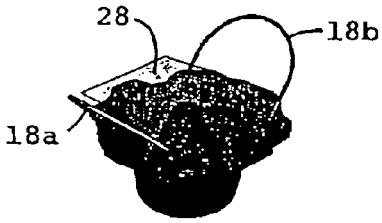

In reference to FIGS. 12 to 14, the parallel sides (19*a*, 19*b*) of sheet (16) with handles (18*a*, 18*b*) are extended by a pliable transparent piece (28) which has noticeably the same surface. The sheet (16) is opaque and surrounds the support element (14) after lifting handles (18*a*, 18*b*) as in FIGS. 1 to 3. Transparent piece (28) is then folded in the direction of arrow F3 around intermediate edge (19), joining the two sides (19*a*, 19*b*) (FIG. 13), in such a way as to pass between handles (18*a*, 18*b*) to cover and protect the bottom of the bouquet (FIG. 14).

Figure 16:
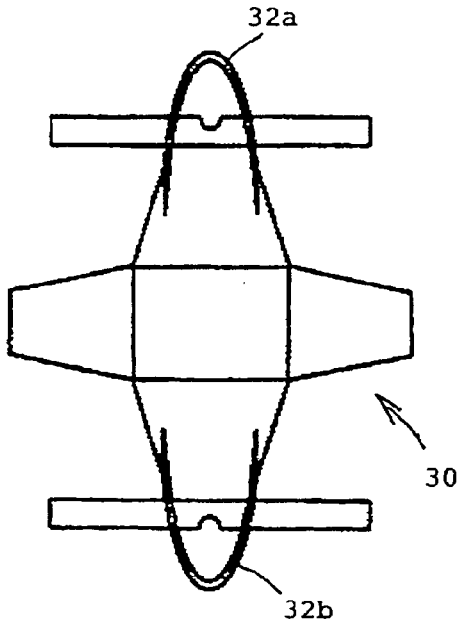
FIGS. 15 and 16 are views in the unfolded position of a protective box designed to enclose the packaged bouquet according to FIG. 3A. The box is shown, respectively, with and without additional handles.
Figure 15:
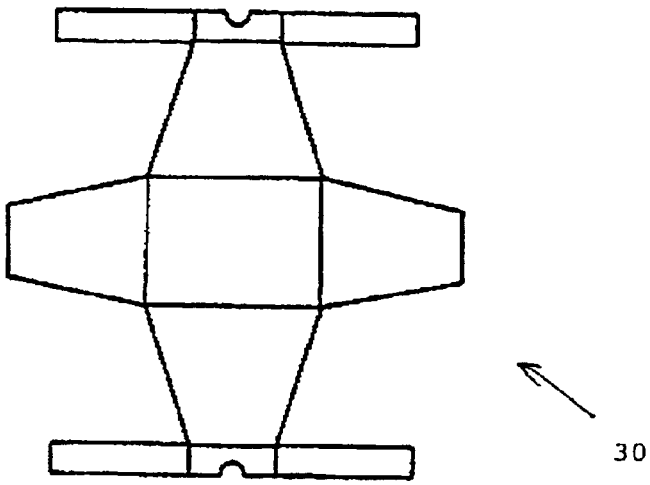

In FIGS. 15 and 16, a box (30) is cut out of cardboard that is of greater stiffness than the material of the flexible sheet (16). This box (30) can be shaped around the watertight sheet (16) of wrapped bouquet (12) in FIG. 3A, so as to give it maximum protection during transport. Box (30) is shown without handles (FIG. 15) or with handles (32*a*, 32*b*) (FIG. 16).

What is claimed is:

1. A portable packaging device for a bouquet of flowers, comprising:

a support element (14) for supporting the bouquet (12);

a packaging sheet (16) of flexible material designed to enclose the support element (14);

transport means (18) on the packaging sheet (16), characterized by the fact that the transport means (18) are arranged so as to be set up when sheet (16) is in a flat unfolded position, and to be positioned in the gripping state when sheet (16) surrounds a lateral surface of the support element (14), the means of transport (18) comprises a pair of handles (18*a*, 18*b*) affixed to the packaging sheet (16) by connecting elements (20*a*, 20*b*); and wherein the transport means (18) cooperates with an extensible tightening link (26) which is an integral part of packaging sheet (16), which is folded and automatically encloses support element (14) when a user pulls on transport means (18).

2. The portable packaging device according to claim 1, characterized by the fact that fixation of the connecting elements (20*a*, 20*b*) to the packaging sheet (16) is carried out by welding, gluing or stapling the connecting elements (20*a*, 20*b*) onto the packaging sheet (16).

3. The portable packaging device according to claim 1, characterized by the fact that the connecting elements (20*a*, 20*b*) comprise back-up fastening elements (24*a*, 24*b*) designed to cooperate to hold sheet (16) with handles (18*a*, 18*b*) in a gripping position.

4. The portable packaging device according to claim 3, characterized by the fact that fastening elements (24*a*, 24*b*) comprise male and female clipping buttons or hook-and-loop fastening strips.

5. The portable packaging device according to claim 1, characterized by the fact that a protective box (30) surrounds sheet (16) of the wrapped bouquet (12), said box being made of precut cardboard which has a greater stiffness than that of flexible sheet (16).

6. The portable packaging device according to claim 1, the packaging device comprising:

a flexible impermeable film cut out according to a predetermined format, and transport means (18), characterized by the fact that the transport means (18) is arranged so as to be set up when sheet (16) is in a flat unfolded state, and to be positioned in the gripping state when sheet (16) encloses the bouquet of flowers or pot of plants; the transport means (18) comprising a pair of handles (18*a*, 18*b*) affixed to the packaging sheet (16) by attaching elements (20*a*, 20*b*).

7. The packaging sheet according to claim 6, characterized by the fact that the film is made of plastic material, notably polypropylene.

8. A portable packaging device for a bouquet of flowers, comprising:

a support element (14) for supporting the bouquet (12);

a packaging sheet (16) of flexible material designed to enclose the support element (14);

transport means (18) on the packaging sheet (16), characterized by the fact that the transport means (18) are arranged so as to be set up when sheet (16) is in a flat unfolded position, and to be positioned in the gripping state when sheet (16) surrounds a lateral surface of the support element (14), the means of transport (18) comprises a pair of handles (18*a*, 18*b*) affixed to the packaging sheet (16) by connecting elements (20*a*, 20*b*);

wherein the packaging sheet (16) is extended by a pliable transparent piece (28), designed to pass between handles (18*a*, 18*b*) so that it covers the bottom of bouquet (12); and wherein the fixation of the connecting elements (20*a*, 20*b*) to the packaging sheet (16) is carried out by welding, gluing or stapling the connecting elements (20*a*, 20*b*) onto the packaging sheet (16).

9. The portable packaging device according to claim 8, characterized by the fact that packaging sheet (16) has a quadrangular, circular or oval surface.

* * * * *